United States Patent [19]

Donath et al.

[11] Patent Number: 4,918,876

[45] Date of Patent: Apr. 24, 1990

[54] DEVICE TO DEBURR MOLDED PARTS SUBJECT TO LOW-TEMPERATURE BRITTLENESS

[75] Inventors: Sabine Donath, Oberhausen; Peter Grund, Erkrath; Peter Holz, Linnich; Udo Jakobs, Krefeld; Wolfgang Volker, Tonisvorst, all of Fed. Rep. of Germany

[73] Assignee: Messer Griesheim GmbH, Fed. Rep. of Germany

[21] Appl. No.: 322,784

[22] Filed: Mar. 13, 1989

[30] Foreign Application Priority Data

Mar. 26, 1988 [DE] Fed. Rep. of Germany ..... 3810463

[51] Int. Cl.[5] ..... B24C 3/04; B24B 31/10

[52] U.S. Cl. ..... 51/426; 51/425; 51/7; 51/320; 51/322; 51/314

[58] Field of Search ..... 51/322, 320, 317, 17, 51/313, 314, 7, 425, 426, 410, 422

[56] References Cited

U.S. PATENT DOCUMENTS

| | | | |
|---|---|---|---|
| 1,400,585 | 12/1921 | Washburn | 51/426 |
| 2,996,846 | 8/1961 | Leliaert | 51/322 |
| 3,702,519 | 11/1972 | Rice | 51/322 |
| 4,646,484 | 3/1987 | Brull | 51/322 |

FOREIGN PATENT DOCUMENTS

| | | | |
|---|---|---|---|
| 0455838 | 3/1975 | U.S.S.R. | 51/7 |
| 0518323 | 7/1976 | U.S.S.R. | 51/7 |
| 0656815 | 4/1979 | U.S.S.R. | 51/7 |
| 1007940 | 3/1983 | U.S.S.R. | 51/7 |
| 0849340 | 9/1960 | United Kingdom | 51/7 |

*Primary Examiner*—Robert Rose

*Attorney, Agent, or Firm*—Connolly and Hutz

[57] ABSTRACT

Molded parts are deburred by being cooled down and treated with an abrasive. The parts are cooled down and circulated by a conveying gas which circulates in a circulation chamber, while the parts are treated with an abrasive introduced into the circulation chamber.

7 Claims, 2 Drawing Sheets

DEVICE TO DEBURR MOLDED PARTS SUBJECT TO LOW-TEMPERATURE BRITTLENESS

BACKGROUND OF INVENTION

Molded parts made of elastomers and duromers are deburred in that they are cooled down by means of a cooling agent and treated with an abrasive. As a result of the cooling process, the burrs of the molded parts become brittle and they can then easily be removed by the high-speed action of the abrasive. Cooling down is achieved by a cryogenic cooling agent, such as liquid nitrogen or carbon dioxide. For this purpose, deburring devices in the form of drums, rotary plates or revolving belts are employed to keep the molded parts constantly circulating. Cooling down can be achieved, for example, by spraying liquid nitrogen, while the abrasive is commonly applied. by blowers. Such devices have become known in a variety of versions such as, for example, West German Patent No. DE-PS 25 16 721 and West German Published Application No. DE-OS 33 33 431.

Although it is possible to satisfactorily deburr molded parts subject to low-temperature brittleness with such devices, they consume a relatively high amount of drive power. The reason for this is that the weight of the powered device parts far exceeds the weight of the molded parts to be deburred. Since not only the molded parts but also all parts of the device which come into contact with the molded parts have to be cooled down to the deburring temperature, these known deburring devices are not very well suited when it comes to a discontinuous mode of operation with prolonged stand-still times. Every time operation is started up again, the whole unit first has to be cooled down to the operating temperature once again, a procedure which is time-consuming and calls for a high consumption of cooling agent. But, in fact, such discontinuous operations are becoming more frequent nowadays since many customers order small batches to be manufactured according to their individual specifications.

SUMMARY OF INVENTION

Consequently, the invention is based on the task of creating a process and a device for deburring molded parts subject to low-temperature brittleness, which only requires low drive power and has a versatile range of application, even in the case of discontinuous production methods with prolonged stand-still times.

The process according to the invention is based on the principle of a cyclical reactor, through which the molded parts to be deburred are continuously passed on a cyclical course until the desired deburring effect has been achieved. The molded parts are lifted and carried along by the cold conveying gas flow. At the highest point of the circulation chamber, the direction of movement makes a 180°-turn onto an arc-shaped course. The molded parts fall down and slide or roll back via an inclined surface. It is advantageous to separate and to collect the abrasive with a sieve and to recycle it into the device for the abrasive feed.

It is possible to deburr a large number of molded parts in this manner, by continuously whirling them in the circulation chamber until the desired level of deburring has been achieved. In the case of heavy or highly immobile molded parts, it is advantageous to divide the circulation chamber into an acceleration zone and an expansion zone, by means of a vertical partition, for example.

The molded parts are then lifted and carried along by the flow of conveying gas in the smooth acceleration zone. At the highest point of the acceleration zone, the direction of movement makes a 180°-turn onto an arc-shaped course. Immediately after this turn, the acceleration zone opens into the expansion zone with a wide flow cross-section. This ensures that the flow rate of the conveying gas is drastically reduced.

The molded parts fall down and slide or roll back via an inclined surface to the beginning of the acceleration zone. It is advantageous to have holes or slits in one section of the inclined surface so that the abrasive can fall through these openings. It is then collected and recycled into the device for the abrasive feed.

The conveying gas flow should preferably consist of a mixture of dry air and nitrogen, to which the necessary volume of liquid nitrogen is continuously added. It is also possible to use carbon dioxide instead of nitrogen. Any desired temperature between room temperature and the temperature of the low-boiling liquefied gas can be set with the help of a process-control system. The conveying gas flow is driven by a low-temperature-resistant fan with strong blowing power.

The molded parts are rapidly cooled down to the desired deburring temperature by the cold conveying gas flow due to its high flow rate and the resulting relative flow rate on the surfaces of the molded parts. The abrasive is preferably administered through an injector. The injector is likewise operated with a mixture of air and evaporated low-boiling liquified gas at a low temperature and at pressure levels between 3 and 15 bar, preferably 6 to 8 bar. Since the outlet speed of the abrasive particles is much greater than the gas flow rate of the molded parts, the abrasive particles collide with the molded parts and deburr them.

Some molded parts tend to adhere to the bottom part of the circulation chamber. This can be prevented by keeping the parts in motion by means of brief, periodical bursts of gas through a special line into the places where the parts accumulate. During the deburring procedure, the circulation chamber can be tilted; if necessary, it can operate in this position continuously. This also prevents adherence of the molded parts. Dividing the circulation chamber into an acceleration zone and an expansion zone has the effect of lifting the molded parts, the abrasive particles, the burrs, dust and the conveying gas flow into the acceleration zone. The conveying gas is withdrawn from the expansion zone via a sieve and a filtering system. The sieve and filter are responsible for removing burrs and dust. Subsequently, the conveying gas flows to the fan. After leaving the fan, a certain volume of low-boiling liquified gas is added to the conveying gas flow at a controlled temperature. In order to prevent an inadmissible rise in pressure, an appropriate quantity of the conveying gas is released into the outside environment after passing through the filter and being cleaned.

The geometrical form of the molded parts made of elastomers or thermoset plastic in the acceleration zone is crucial for transport efficiency. The force that lifts and turns the molded parts results from the contact surface exposed to the circulation gas, the drag coefficient, the viscosity of the cold gas, the specific weight of the cold gas, the flow rate of the flowing gas and the pressure exerted by the abrasive particles onto the surface.

A high flow rate of the conveying gas is advantageous for the favorable cold transfer necessary for deburring. Large-volume molded parts can be advantageously deburred by the process according to the invention since they usually have very thin walls and are thus highly sensitive to rough circulation in drums and similar devices. The cold pressure gas with which the injector is operated contributes greatly to cooling down the surface of the molded parts and their burrs.

The process according to the invention is tailor-made for the trend that can be observed in the rubber industry, namely, to process small batches with small extruders in various industry units. The process according to the invention can be operated as a combined centralized/decentralized system. Preparing and cooling down the air for the conveying gas flow can be done centrally. On the other hand, cooling down to the process temperature, removing the dust and treating with the abrasive can be carried out decentrally. Very little equipment is needed, especially if the injector is also used to suck up the abrasive. Therefore, the device to execute the process according to the invention can be very small and compact. This, in turn, makes it possible to install high-quality insulation whose costs are affordable thanks to the small dimensions of the system. In the case of a standstill, the unit only warms up gradually, so that even after a standstill of several hours, the unit is immediately ready for operation.

A special feature of the device according to the invention is the fact that it does not have any mechanically moving parts to circulate the molded parts. The circulation rate of the molded parts is approximately 1 second. Since, at any given moment, only a small portion of the molded parts in circulation is exposed to a very intense flow of abrasive particles, each molded part is blasted over more than 50% of its surface in every cycle. Seeing that the actual deburring takes place in a matter of seconds, even extremely sensitive molded parts can be deburred with the process according to the invention.

THE DRAWINGS

DETAILED DESCRIPTION

Figure 1:
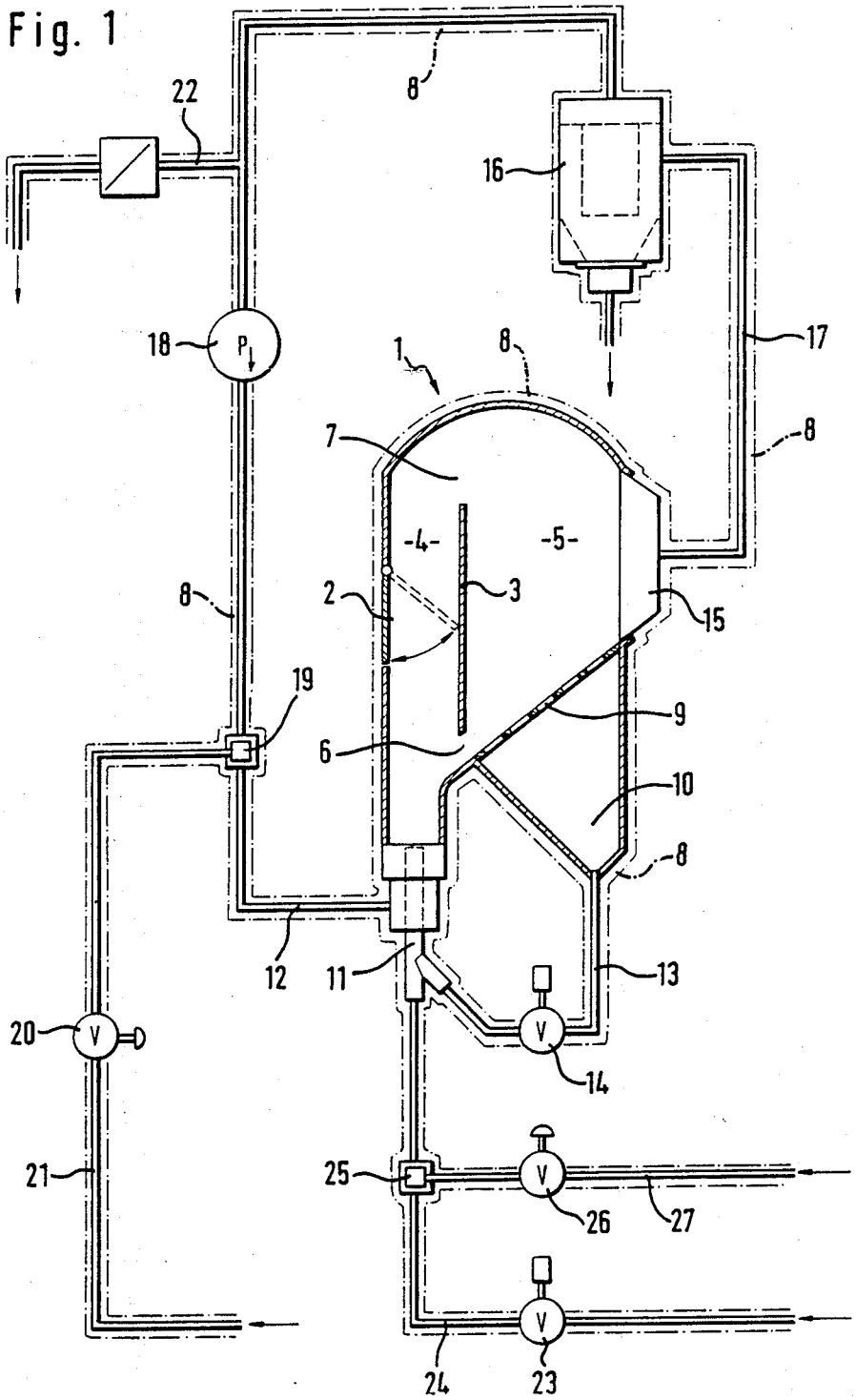
FIG. 1 is a simplified schematic of the deburring process in a circulation chamber with an acceleration zone and an expansion zone in accordance with this invention.

FIG. 1 shows a circulation chamber 1, in which the molded parts are deburred. The circulation chamber 1 has a lockable filling and removal opening 2 for putting in and taking out the molded parts. The circulation chamber 1 is divided by means of a partition 3 into an acceleration zone 4 with a small flow cross-section and an expansion zone 5 with a wide flow cross-section. The expansion zone 5 is connected to the beginning of the acceleration zone 4 via an opening 6. An opening 7 allows for the transition from the acceleration zone 4 into the expansion zone 5. All of the surfaces of the circulation chamber 1 and of the pipelines which come into contact with the surrounding environment are protected from the influence of heat by insulation 8. The floor of the expansion zone 5 is designed as an inclined surface, and it leads back into the acceleration zone 4 via the opening 6. A section of this inclined surface is designed as a perforated plate, under which the collecting bin for the abrasive is located. The abrasive is inserted into the beginning of the acceleration zone 4 by means of the injector 11.

After the molded parts to be deburred have been placed into the circulation chamber 1 through the filling and removal opening 2, the device is put into operation by initiating the feed of the abrasive by means of the injector 11 and the flow of the conveying gas through line 12, also into the beginning of the acceleration zone 4. This causes the molded parts to be lifted and carried along through the acceleration zone. At the same time, intensive deburring takes place due to the effect of the abrasive in the lower section of the acceleration zone 4. After passing the opening 7 and turning by 180°, the flow rate in the expansion zone 5 is drastically reduced. The molded parts fall onto the perforated plate 9 and slide back through the opening 6 to the beginning of the acceleration zone 4, where they once again come into contact with the conveying gas and the abrasive. The abrasive particles fall through the perforated plate 9 into the collecting bin 10 for the abrasive, from where they are once again sucked up by the injector 11 via line 13, which is equipped with a stop valve 14. In order to facilitate separation of the abrasive, the perforated plate 9 can also be designed as a vibrating sieve. The abrasive in the collecting bin can also be further treated in order to remove dust and loose burrs.

The conveying gas is sucked up through line 17 from the expansion zone, and then it passes through a sieve 15 and a filter 16 so that loose burrs and dust can be removed. Subsequently, it reaches the fan 18, where pressure losses are compensated for, after which it moves to the mixing station 19. In the mixing station 19, liquid nitrogen is added to the conveying gas flow at a controlled temperature via line 21, which is equipped with a metering valve 20. Gas is continuously released before fan 18 via line 22; this volume of gas corresponds to the volume of nitrogen fed in via line 21 and the volume of gas administered by the injector 11.

Dry compressed air is used as pressure gas for the injector 11 and it is administered via line 24, which is equipped with a valve 23. In the mixing station 25, liquid nitrogen is also added to this compressed air at a controlled temperature via line 27, which is equipped with a valve 26.

The circulation chamber 1 can be equipped with a window in order to make it possible to easily see when the desired deburring has been achieved and the device can be turned off.

Many different variations and additional features are possible. Thus, for example, it is possible to install turning strips or baffles in the expansion zone 5 in order to assure, especially in the case of large molded parts like O-rings, that the bottom will be flipped to the top after every cycle. The abrasive from the abrasive collecting bin 10 can be stored in an intermediate bin located higher than the injector in order to facilitate the feeding of abrasive to the injector 11. This can be done with the help of an additional gas flow, and dust and loose burrs can be removed at the same time from the abrasive. The injector 11 can be operated with an automatic suction feature or an excess pressure feeding feature. Instead of an injector, it is also possible to use blowers which have a suction feature or an inlet-dosing feature. The abrasive does not necessarily have to be administered at the beginning of the acceleration zone 4, although, as a rule, this is the most favorable place to do so. For instance, the abrasive can also be administered near opening 7. The pressure gas coming from line 24 to power the injector 11 does not necessarily have to have the same temperature as the conveying gas.

In special cases, higher temperatures—up to room temperature—are admissible for the pressure gas. The acceleration zone 4 does not have to run vertically upwards, but it can also be inclined. In the same manner, the flow cross-section of the acceleration zone 4 can have different lengths. The circulation chamber 1 can also be operated in an inclined position or be inclined during operation.

Instead of the described process with air and nitrogen, it is also possible to operate the device with carbon dioxide. In this case, liquid carbon dioxide is introduced into the beginning of the acceleration zone 4. The liquid carbon dioxide expands and changes into cold gas and carbon dioxide ice. Here, the carbon dioxide ice serves as the abrasive. Such versions, operated exclusively with carbon dioxide, can be designed as extremely compact and small units so that they can be set up directly next to production units for molded parts. It is also possible to directly link several circulation chambers 1 one after the other. This allows for continuous deburring, which can be carried out in the various circulation chambers 1 with various processing parameters such, as for example, different impact speeds of the abrasive, different grain sizes of the abrasive or different deburring temperatures. Removing the deburred molded parts from the circulation chamber 1 can also be done by means of the conveying gas flow by increasing the volume and speed of the conveying gas flow for a brief period of time, so that the molded parts do not fall onto the perforated plate 9 but rather, they are collected by a collecting device located in the sieve 15.

Figure 2:
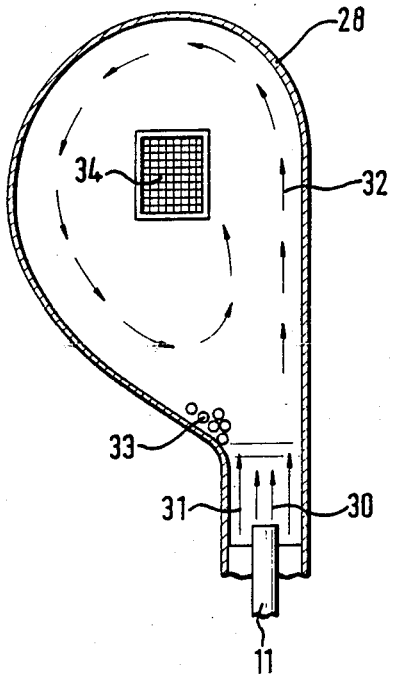
FIG. 2 illustrates a circulation chamber without an acceleration zone in accordance with a further embodiment of this invention.
Figure 3:
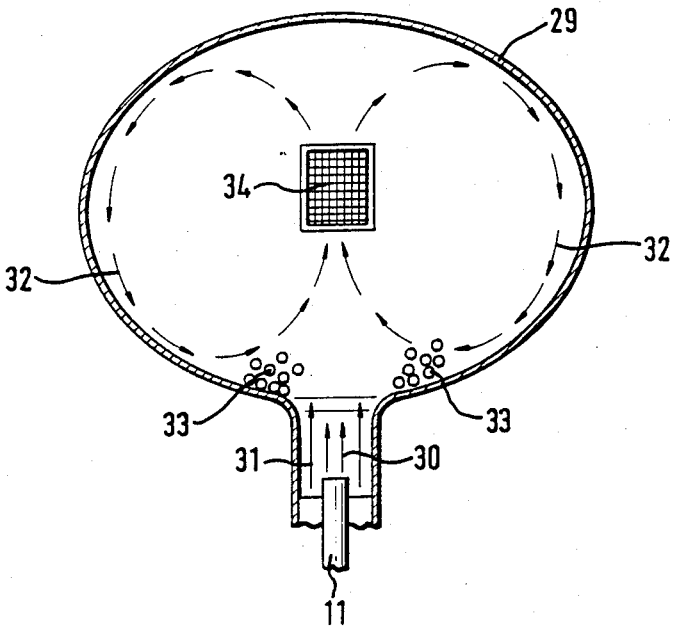
FIG. 3 another circulation chamber without an acceleration zone in accordance with another embodiment of this invention.

FIGS. 2 and 3 show very simplified versions of circulation chambers 28 and 29, which are not divided into acceleration zones and expansion zones. They are especially suited to deburr light and easily movable molded parts. The direction of movement is shown by arrows. The arrows 30 symbolize the abrasive coming from the injector 11, the arrows 31 the conveying gas as it enters the circulation chamber 28 or 29 and the arrows 32 the joint course followed by the molded parts, the conveying gas and the abrasive. After each cycle, the molded parts 33 end up near the injector and once again come into contact with the abrasive and the conveying gas. Abrasive, loose burrs, dust and conveying gas are sucked off through the sieve 34. The abrasive and the conveying gas are treated again, similar to the way shown in FIG. 1. In special cases, it is also possible to operate the device only with the pressure gas which powers the injector 11 and to do without the actual conveying gas.

SUMMARY OF INVENTION

Up until now, molded parts which are subject to low temperature brittleness were deburred by cooling down and exposure to an abrasive in rotating drums or transport belts with circulating devices. In the case of discontinuous modes of operation, a great deal of cooling energy is necessary to cool down the deburring device to the operating temperature, because not only the moving parts but also the stationary parts of the device have to be cooled down. Since the mass of the rotating or circulating parts of the device is very large in comparison to the mass of the molded parts to be deburred, a great deal of drive power is also consumed.

In order to achieve an energy-saving mode of operation for continuous and discontinuous operation, molded parts are circulated in a stationary circulation chamber 1 by means of a circulating cold conveying gas flow. The circulation chamber can be divided into a vertical acceleration zone 4 and an adjoining expansion zone 5, from which the molded parts move back to the acceleration zone after completing each cycle (FIG. 1).

What is claimed is:

1. In a device for deburring molded parts subject to low-temperature brittleness in which the molded parts are circulated and cooled down by a cryogenic agent and treated with an abrasive, the improvement being in a substantially closed circulation chamber, means for circulating the conveying gas in said circulation chamber to cool down and circulate the molded parts, means for supplying abrasive into said circulation chamber for treating the molded parts said circulation chamber having a lockable filling and removal opening for putting in and taking out the molded parts, said circulation chamber having connections for introducing and removing the conveying gas and a connection for administering the abrasive, a partition dividing said circulation chamber into an acceleration zone with a small flow cross-section and an expansion zone with a wide flow cross-section; an opening for the transition from said acceleration zone into said expansion zone, and an opening linking said expansion zone with the beginning of said acceleration zone.

2. Device according to claim 1, characterized by a partition arranged in a vertical position.

3. Device according to claim 1, characterized by a perforated plate installed in said expansion zone to separate the abrasive.

4. Device according to claims 1, characterized by a filter to remove dust and loose burrs located in the outlet line which carries the conveying gas leading out of said circulation chamber.

5. Device according to claim 1, characterized by a mixing station to dose the volume of liquid nitrogen into the feed line which carries the conveying gas into said circulation chamber.

6. Device according to claim 5, characterized by a partition arranged in a vertical position, a perforated plate installed in said expansion zone to separate the abrasive, and a filter to remove dust and loose burrs located in the outlet line which carries the conveying gas leading out of said circulation chamber.

7. Device according to claim 1, characterized by the abrasive being supplied into the bottom section of said acceleration zone.

* * * * *